US008813693B2

(12) United States Patent
Bialas et al.

(10) Patent No.: US 8,813,693 B2
(45) Date of Patent: Aug. 26, 2014

(54) DIAGNOSTIC SYSTEM AND METHOD FOR A SWITCHABLE WATER PUMP

(75) Inventors: Daniel A. Bialas, Ann Arbor, MI (US); Stephen Paul Levijoki, Swartz Creek, MI (US); John W. Siekkinen, Novi, MI (US); Igor Anilovich, Walled Lake, MI (US); Michele Bilancia, Turin (IT); Morena Bruno, Chivasso (IT)

(73) Assignee: GM Global Technology Operations LLC

( * ) Notice: Subject to any disclaimer, the term of this patent is extended or adjusted under 35 U.S.C. 154(b) by 395 days.

(21) Appl. No.: 13/269,048

(22) Filed: Oct. 7, 2011

(65) Prior Publication Data

US 2013/0089436 A1 Apr. 11, 2013

(51) Int. Cl.

| | |
|---|---|
| ***F01P 5/14*** | (2006.01) |
| ***G01M 17/00*** | (2006.01) |
| ***G01M 15/00*** | (2006.01) |

(52) U.S. Cl.

USPC ..... 123/41.15; 123/198 D; 701/33.6; 73/114.68

(58) Field of Classification Search

CPC ..... F01P 7/00; F01P 11/16; F01P 11/18; F01P 11/14; F02D 17/04; F02B 77/08; F02B 3/06; G01M 15/00; G01M 17/00; G01N 7/20; G06F 7/00

USPC ..... 123/41.15, 198 D; 73/114.68, 168; 701/29.1, 31.6, 33.6, 33.7

See application file for complete search history.

(56) References Cited

U.S. PATENT DOCUMENTS

| | | | | |
|---|---|---|---|---|
| 6,169,953 | B1 * | 1/2001 | Panoushek et al. | 701/99 |
| 6,397,820 | B1 | 6/2002 | Novak et al. | |
| 7,409,928 | B2 | 8/2008 | Rizoulis et al. | |
| 7,997,510 | B2 | 8/2011 | Pavia et al. | |
| 8,224,517 | B2 * | 7/2012 | Eser et al. | 701/31.4 |
| 2012/0215397 | A1 | 8/2012 | Anilovich et al. | |
| 2013/0089436 | A1 | 4/2013 | Bialas et al. | |

OTHER PUBLICATIONS

U.S. Appl. No. 13/606,565, filed Sep. 7, 2012, Stephen Paul Levijoki.
U.S. Appl. No. 13/111,318, filed May 19, 2011, Daniel A. Bialas et al.
Non-Final Office Action dated Jan. 3, 2014 in U.S. Appl. No. 13/111,318; 5 pages.

* cited by examiner

*Primary Examiner* — Noah Kamen

(57) ABSTRACT

A system includes a pump control module and a pump diagnostic module. The pump control module switches a switchable water pump from off to on. The pump diagnostic module diagnoses a fault in the switchable water pump based on a first difference between an engine material temperature and an engine coolant temperature when the switchable water pump is switched from off to on. The engine coolant temperature is a temperature of coolant circulated through an engine and the engine material temperature is a temperature of at least one of an engine block and a cylinder head.

20 Claims, 4 Drawing Sheets

DIAGNOSTIC SYSTEM AND METHOD FOR A SWITCHABLE WATER PUMP

CROSS-REFERENCE TO RELATED APPLICATIONS

This application is related to U.S. patent application Ser. No. 13/111,318 filed on May 19, 2011. The disclosure of the above application is incorporated herein by reference in its entirety.

FIELD

The present disclosure relates to switchable water pumps for an engine, and more particularly, to diagnostic systems and methods for a switchable water pump.

BACKGROUND

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

Typically, engine water pumps are belt-driven centrifugal pumps that circulate coolant through an engine to cool the engine. Coolant is received through an inlet located near the center of a pump, and an impeller in the pump forces the coolant to the outside of the pump. Coolant is received from a radiator, and coolant exiting the pump flows through an engine block and a cylinder head before returning to the radiator.

In a conventional water pump, the impeller is always engaged with a belt-driven pulley. Thus, the pump circulates coolant through the engine whenever the engine is running. In contrast, a switchable water pump includes a clutch that engages and disengages the impeller to switch the pump on and off, respectively. The pump may be switched off to reduce the time required to warm the engine at startup and/or to improve fuel economy, and the pump may be switched on to cool the engine. However, the pump may not switch on or off as commanded due to, for example, a stuck clutch.

SUMMARY

A system includes a pump control module and a pump diagnostic module. The pump control module switches a switchable water pump from off to on. The pump diagnostic module diagnoses a fault in the switchable water pump based on a first difference between an engine material temperature and an engine coolant temperature when the switchable water pump is switched from off to on. The engine coolant temperature is a temperature of coolant circulated through an engine and the engine material temperature is a temperature of at least one of an engine block and a cylinder head.

Further areas of applicability of the present disclosure will become apparent from the detailed description provided hereinafter. It should be understood that the detailed description and specific examples are intended for purposes of illustration only and are not intended to limit the scope of the disclosure.

BRIEF DESCRIPTION OF THE DRAWINGS

The present disclosure will become more fully understood from the detailed description and the accompanying drawings, wherein.

DETAILED DESCRIPTION

A system and method according to the present disclosure diagnoses a fault in a water pump based on the difference between an engine material temperature (EMT) and an engine coolant temperature (ECT) when the water pump is switched on. The EMT is the temperature of the material from which an engine is made. For example, the EMT may be measured in a cylinder head and/or in an engine block. When the water pump switches from off to on, the difference between the EMT and the ECT decreases.

However, if the water pump is stuck on or off, switching on the water pump does not decrease the difference between the EMT and the ECT. Thus, a fault in a water pump may be diagnosed based on the difference between the EMT and the ECT when the water pump is switched on. A fault in a water pump may be diagnosed based on a maximum decrease in the difference between the EMT and the ECT during a diagnostic period after the water pump is switched on. A stuck-on fault or a stuck-off fault may be diagnosed when the maximum decrease is less than a first threshold.

The stuck-off fault may be diagnosed when the difference between the EMT and the ECT is greater than a second threshold at the end of the diagnostic period. The stuck-on fault may be diagnosed when the difference between the EMT and the ECT is less than or equal to the second threshold at the end of the diagnostic period. A diagnostic trouble code (DTC) may be set and/or a service indicator, such as a light, may be activated when the stuck-on fault or the stuck-off fault is diagnosed. In addition, torque output of the engine may be limited when the stuck-off fault is diagnosed.

Diagnosing a water pump that is stuck off and limiting engine torque output when the water pump is stuck off prevents engine damage due to overheating. Activating a service indicator when the water pump is stuck off may also prevent engine damage if the water pump is replaced when the service indicator is activated. Preventing engine damage reduces warranty costs and increases customer satisfaction. Activating a service indicator when the water pump is stuck on may improve fuel economy if the water pump is replaced when the service indicator is activated. Setting a DTC when the water pump is stuck on or off improves service diagnostic capabilities, for example, when the vehicle is serviced after the service indicator is activated.

Figure 1:
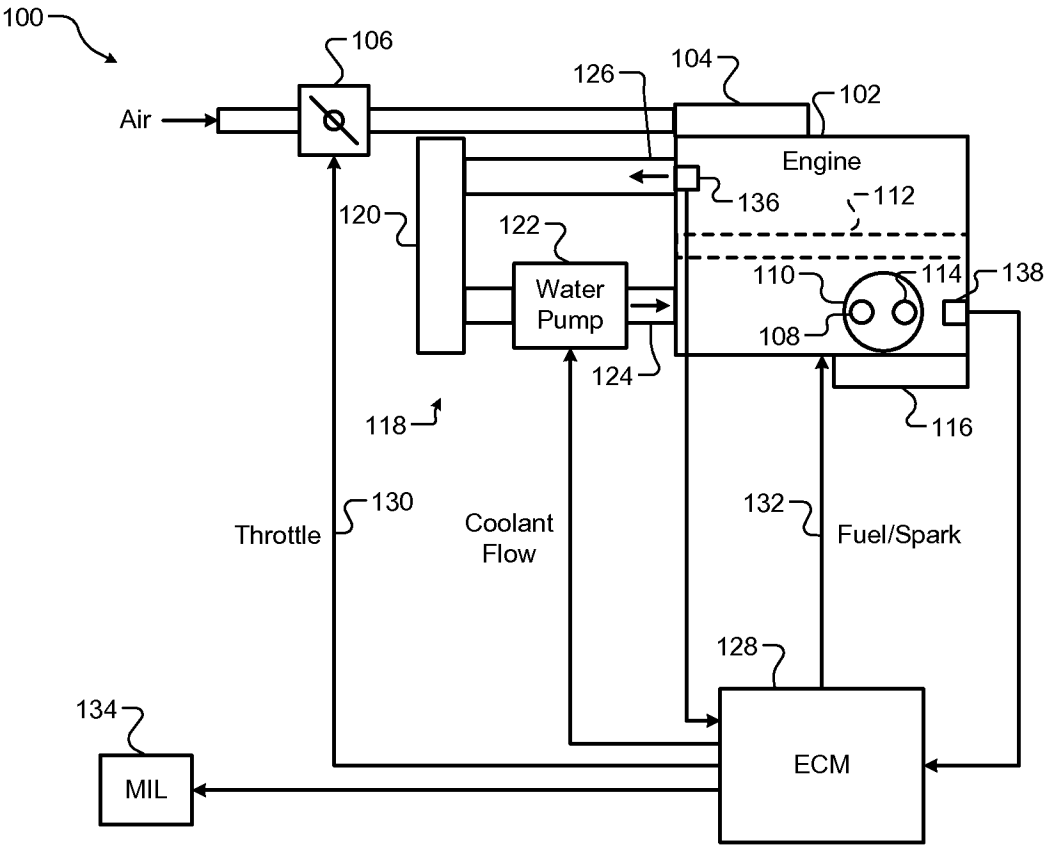
FIG. 1 is a functional block diagram of an example engine system according to the principles of the present disclosure.

Referring to FIG. 1, a functional block diagram of an example engine system 100 is presented. An engine 102 generates drive torque for a vehicle. While the engine 102 is shown and will be discussed as a spark-ignition, the engine 102 may be another suitable type of engine, such as a compression-ignition engine. Air is drawn into the engine 102 through an intake manifold 104. Airflow into the engine 102 may be varied using a throttle valve 106. One or more fuel injectors, such as a fuel injector 108, mix fuel with the air to form an air/fuel mixture. The air/fuel mixture is combusted within cylinders of the engine 102, such as a cylinder 110.

Although the engine 102 is depicted as including one cylinder, the engine 102 may include more than one cylinder.

The cylinder 110 includes a piston (not shown) that is mechanically linked to a crankshaft 112. One combustion cycle within the cylinder 110 may include four phases: an intake phase, a compression phase, a combustion phase, and an exhaust phase. During the intake phase, the piston moves toward a bottommost position and draws air into the cylinder 110. During the compression phase, the piston moves toward a topmost position and compresses the air or air/fuel mixture within the cylinder 110.

During the combustion phase, spark from a spark plug 114 ignites the air/fuel mixture. The combustion of the air/fuel mixture drives the piston back toward the bottommost position, and the piston drives rotation of the crankshaft 112. Resulting exhaust gas is expelled from the cylinder 110 through an exhaust manifold 116 to complete the exhaust phase and the combustion cycle. The engine 102 outputs torque to a transmission (not shown) via the crankshaft 112.

A cooling system 118 for the engine 102 includes a radiator 120 and a water pump 122. The radiator 120 cools coolant that flows through the radiator 120, and the water pump 122 circulates coolant through the engine 102 and the radiator 120. Coolant flows from the radiator 120 to the water pump 122, from the water pump 122 to the engine 102 through an inlet hose 124, and from the engine 102 back to the radiator 120 through an outlet hose 126.

The water pump 122 may be a centrifugal pump that includes an impeller engaged with a pulley (not shown) driven by a belt (not shown) connected to the crankshaft 112. Coolant may enter the water pump 122 through an inlet located near the center of the water pump 122, and the impeller may force the coolant radially outward to an outlet located at the outside of the water pump 122. The water pump 122 may be a switchable water pump. For example, the water pump 122 may include a clutch that disengages and engages the impeller and the pulley when the water pump 122 is switched off and on, respectively. Alternatively, the water pump 122 may be an electric pump.

An engine control module (ECM) 128 controls the throttle valve 106, the fuel injector 108, and the spark plug 114, and the water pump 122 based on input received from one or more sensors. The ECM 128 may output a throttle control signal 130 to control the throttle valve 106, and the ECM 128 may output a fuel/spark control signal 132 to control the fuel injector 108 and the spark plug 114. Alternatively, the ECM 128 may control the throttle valve 106, the fuel injector 108, and the spark plug 114 using a single signal or three separate signals.

The ECM 128 may set a diagnostic trouble code (DTC) and/or activate a service indicator, such as or a malfunction indicator light (MIL) 134, based on the input received. When activated, the service indicator indicates a fault in the engine system 100. For example, the ECM 128 may activate the MIL 134 to indicate when the water pump 122 is stuck on or off. Although the MIL 134 is referred to as a light, the MIL 134 may indicate a fault using mediums other than light, including sound and vibration.

The sensors may include an engine coolant temperature (ECT) sensor 136 and an engine material temperature (EMT) sensor 138. The ECT sensor 136 measures the temperature of coolant circulated through the engine 102. The ECT sensor 136 may be positioned in the coolant near the outlet of the engine 102. The EMT sensor 138 measures the temperature of the material (e.g., steel, aluminum) from which the engine 102 is made. The EMT sensor 138 may be positioned in the material of an engine block of the engine 102 or a cylinder head of the engine 102.

The ECM 128 diagnoses a fault in the water pump 122 based on the difference between the engine material temperature and the engine coolant temperature when the water pump 122 is switched on. The ECM 128 may diagnose a fault in the water pump 122 based on a maximum decrease in the difference between the engine material temperature and the engine coolant temperature during a diagnostic period after the water pump 122 is switched on. The ECM 128 may diagnose a stuck-on fault or a stuck-off fault when the maximum decrease is less than a first threshold.

The ECM 128 may diagnose the stuck-on fault when the difference between the engine material temperature and the engine coolant temperature at the end of the diagnostic period is less than or equal to a second threshold. The ECM 128 may diagnose the stuck-off fault when the difference between the engine material temperature and the engine coolant temperature at the end of the diagnostic period is greater than the second threshold. The ECM 128 may limit torque output of the engine 102 when the stuck-off fault is diagnosed.

Figure 2:
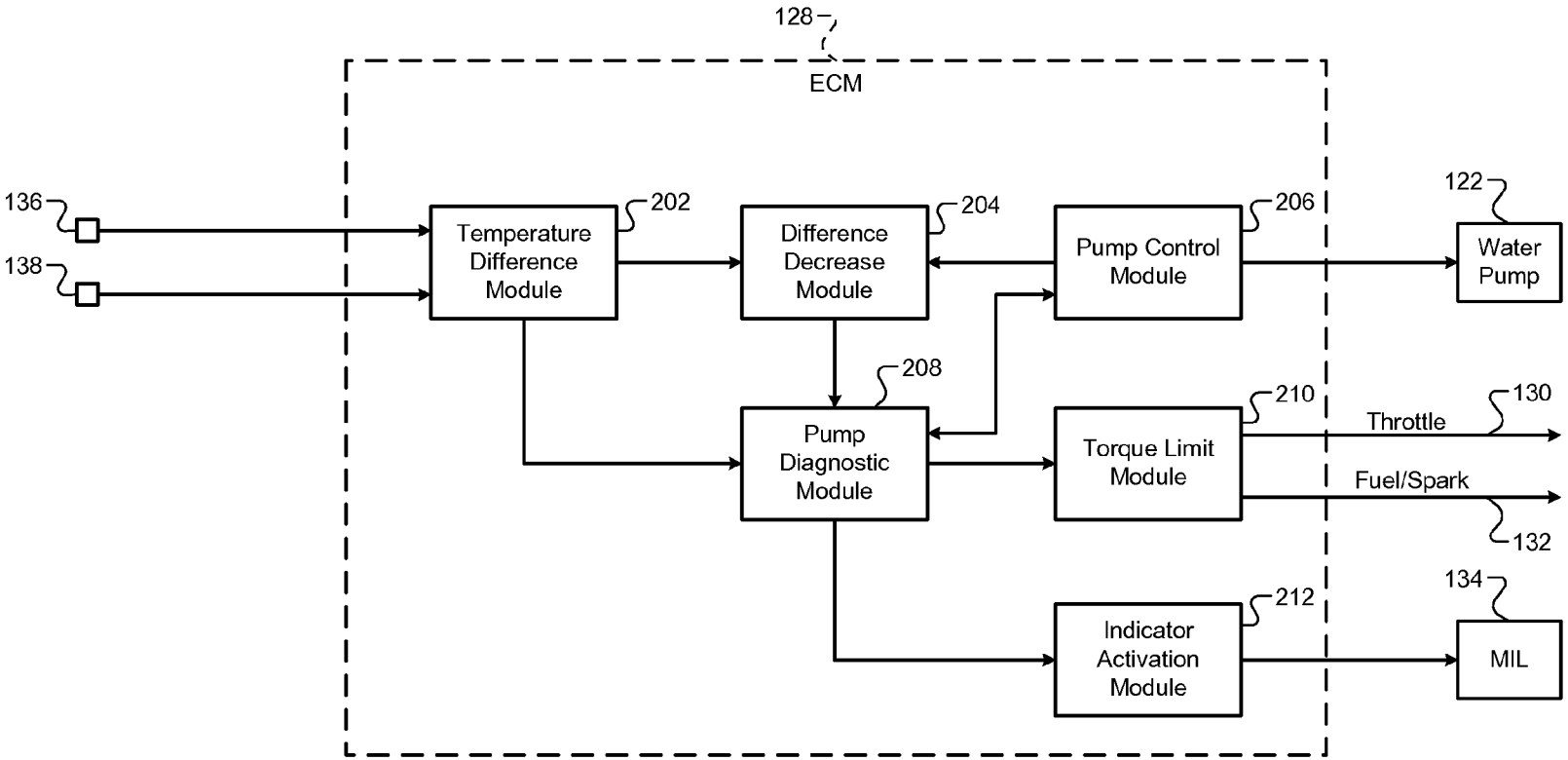
FIG. 2 is a functional block diagram of an example control system according to the principles of the present disclosure.

Referring to FIG. 2, an example of the ECM 128 includes a temperature difference module 202, a difference decrease module 204, a pump control module 206, a pump diagnostic module 208, a torque limit module 210, and an indicator activation module 212. The temperature difference module 202 determines a first difference between the engine coolant temperature and the engine material temperature based on input received from the ECT sensor 136 and the EMT sensor 138. The temperature difference module 202 outputs the first difference.

The difference decrease module 204 determines a maximum decrease in the first difference during a diagnostic period. The diagnostic period starts when the water pump 122 is switched on, and the diagnostic period may end after a predetermined duration (e.g., 12 seconds). The difference decrease module 204 may determine when the water pump 122 is switched on based on input received from the pump control module 206. The difference decrease module 204 outputs the maximum decrease.

The difference decrease module 204 may determine the maximum decrease based on a second difference between a maximum value and a minimum value of the first difference during the diagnostic period. The difference decrease module 204 may determine the maximum value of the first difference during a first portion of the diagnostic period. The difference decrease module 204 may determine the minimum value of the first difference during a second portion of the diagnostic period that follows the first portion. The first portion may have a predetermined duration (e.g., 3 seconds) and the second portion may have a predetermined duration (e.g., 9 seconds). The sum of the predetermined duration of the first portion and the predetermined duration of the second portion may be equal to the predetermined duration of the diagnostic period.

The pump control module 206 controls the water pump 122. The pump control module 206 switches the water pump 122 on and off based on cooling demands of the engine 102. The pump control module 206 may switch the water pump 122 off to reduce the time required to warm the engine 102 at startup and/or to improve fuel economy. The pump control module 206 may switch the water pump 122 on to cool the engine 102. The pump control module 206 may determine the cooling demands of the engine 102 based on the engine material temperature, the engine coolant temperature, and/or engine runtime. The pump control module 206 may control the water pump 122 based on input received from a heating, ventilation, and air conditioning system.

The pump diagnostic module 208 diagnoses a fault in the water pump 122 based on the first difference between the engine material temperature and the engine coolant temperature when the water pump 122 is switched on. The pump diagnostic module 208 may determine when the water pump 122 is switched on or off based on input received from the pump control module 206. The pump diagnostic module 208 may refrain from diagnosing a fault when the water pump 122 is switched off for less than a minimum period (e.g., 20 seconds). The minimum period allows the engine material temperature to increase relative to the engine coolant temperature.

The pump diagnostic module 208 may diagnose a stuck-on fault or a stuck-off fault in the water pump 122 when the maximum decrease in the first difference during the diagnostic period is less than a first threshold. The pump diagnostic module 208 may determine the first threshold based on ambient temperature, which may be measured or estimated. The first threshold may be a predetermined value (e.g., 4 degrees Celsius (° C.)) or within a predetermined range (e.g., 2° C. to 5° C.).

The pump diagnostic module 208 may diagnose the stuck-on fault when the maximum decrease is less than or equal to the first threshold and the first difference is less than a second threshold at the end of the diagnostic period. The second threshold may be a predetermined value (e.g., 6° C.) or within a predetermined range (e.g., 5° C. to 12° C.). The pump diagnostic module 208 may diagnose the stuck-off fault when the maximum decrease is less than the first threshold and the first difference is greater than the second threshold at the end of the diagnostic period.

The torque limit module 210 limits torque output of the engine 102 based on input received from the pump diagnostic module 208. The torque limit module 210 may limit torque output of the engine 102 when the stuck-off fault is diagnosed. The torque limit module 210 may output the throttle control signal 130 and/or the fuel/spark control signal 132. The torque limit module 210 may limit torque output of the engine 102 by adjusting the throttle control signal 130 and/or the fuel/spark control signal 132. For example, the torque limit module 210 may limit torque output of the engine 102 by reducing fuel, retarding spark, and/or reducing throttle.

The indicator activation module 212 activates the service indicator when a fault is diagnosed in the water pump 122. The indicator activation module 212 may activate the MIL 134 when the stuck-off fault or the stuck-on fault is diagnosed. Additionally, the indicator activation module 212 may set a diagnostic trouble code (DTC) when the stuck-off fault or the stuck-on fault is diagnosed. The DTC indicates whether the stuck-off fault or the stuck-on fault is diagnosed. The indicator activation module 212 may store the DTC, and a service technician may receive the DTC using, for example, a service tool that is capable of communicating with the ECM 128.

Figure 3:
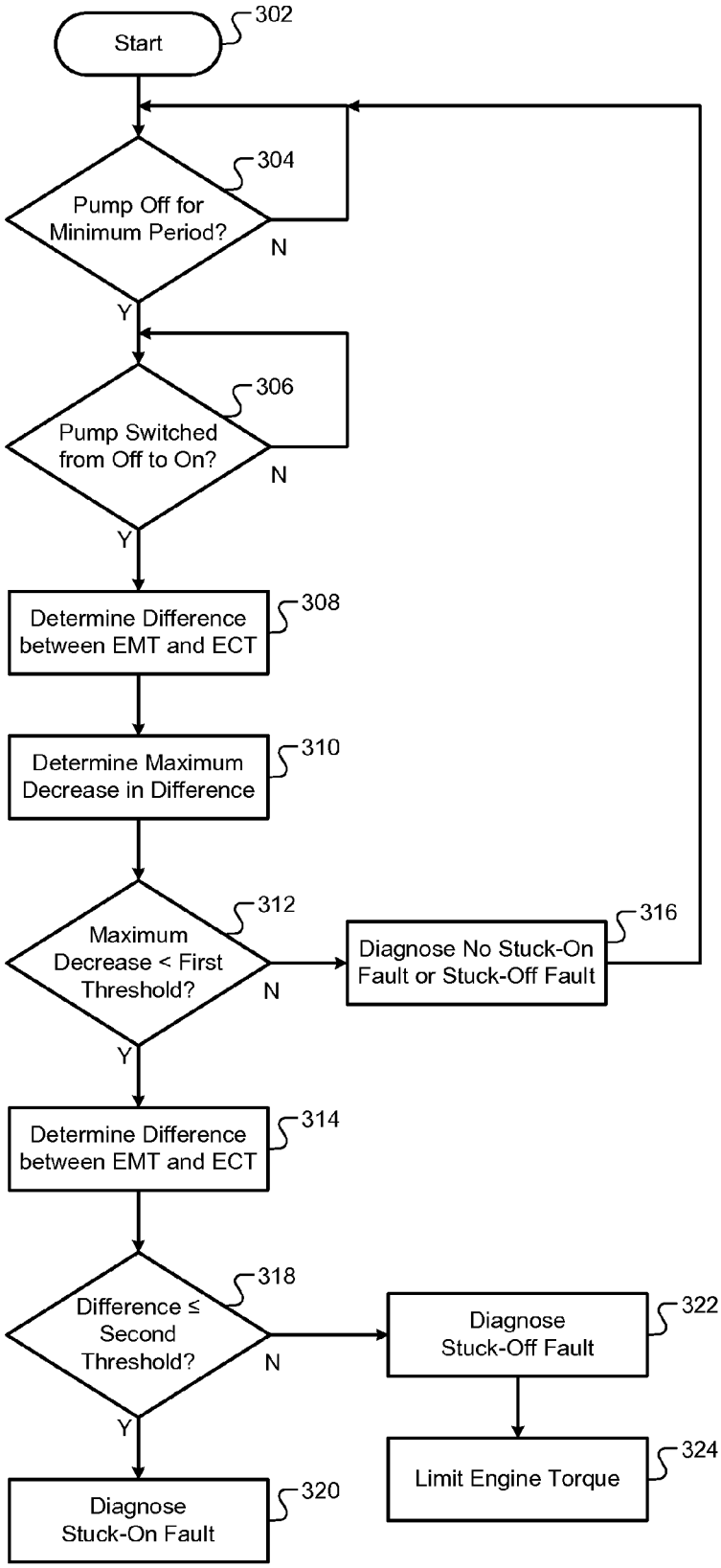
FIG. 3 is a flowchart illustrating an example control method according to the principles of the present disclosure.

Referring to FIG. 3, a method for diagnosing faults in a switchable water pump based on an engine material temperature and an engine coolant temperature starts at 302. At 304, the method determines whether the switchable water pump has been off for a minimum period. The minimum period may have a predetermined duration (e.g., 20 seconds). If 304 is true, the method continues at 306.

At 306, the method determines whether the switchable water pump is switched from off to on. If 306 is true, the method continues to 308. At 308, the method determines a first difference between the engine material temperature and the engine coolant temperature. The method may continue to determine the first difference after the switchable water pump is switched on. At 310, the method determines a maximum decrease in the first difference during a diagnostic period. The diagnostic period may start when the switchable water pump is switched on and may have a predetermined duration (e.g., 12 seconds).

The method may determine the maximum decrease based on a second difference between a maximum value and a minimum value of the first difference during the diagnostic period. The method may determine the maximum value of the first difference during a first portion of the diagnostic period. The method may determine the minimum value of the first difference during a second portion of the diagnostic period that follows the first portion. The first portion may have a predetermined duration (e.g., 3 seconds) and the second portion may have a predetermined duration (e.g., 9 seconds). The sum of the predetermined duration of the first portion and the predetermined duration of the second portion may be equal to the predetermined duration of the diagnostic period.

At 312, the method determines whether the maximum decrease in the first difference during the diagnostic period is less than a first threshold. The method may determine the first threshold based on ambient temperature, which may be measured or estimated. The first threshold may be a predetermined value (e.g., 4° C.) or within a predetermined range (e.g., 2° C. to 5° C.). If 312 is true, the method continues at 314. Otherwise, the method continues at 316 and refrains from diagnosing a stuck-on fault or a stuck-off fault in the switchable water pump. The method may record a result (e.g., pass or fail) of a test for a stuck-on fault or a stuck-off fault in computer readable media.

Figure 4:
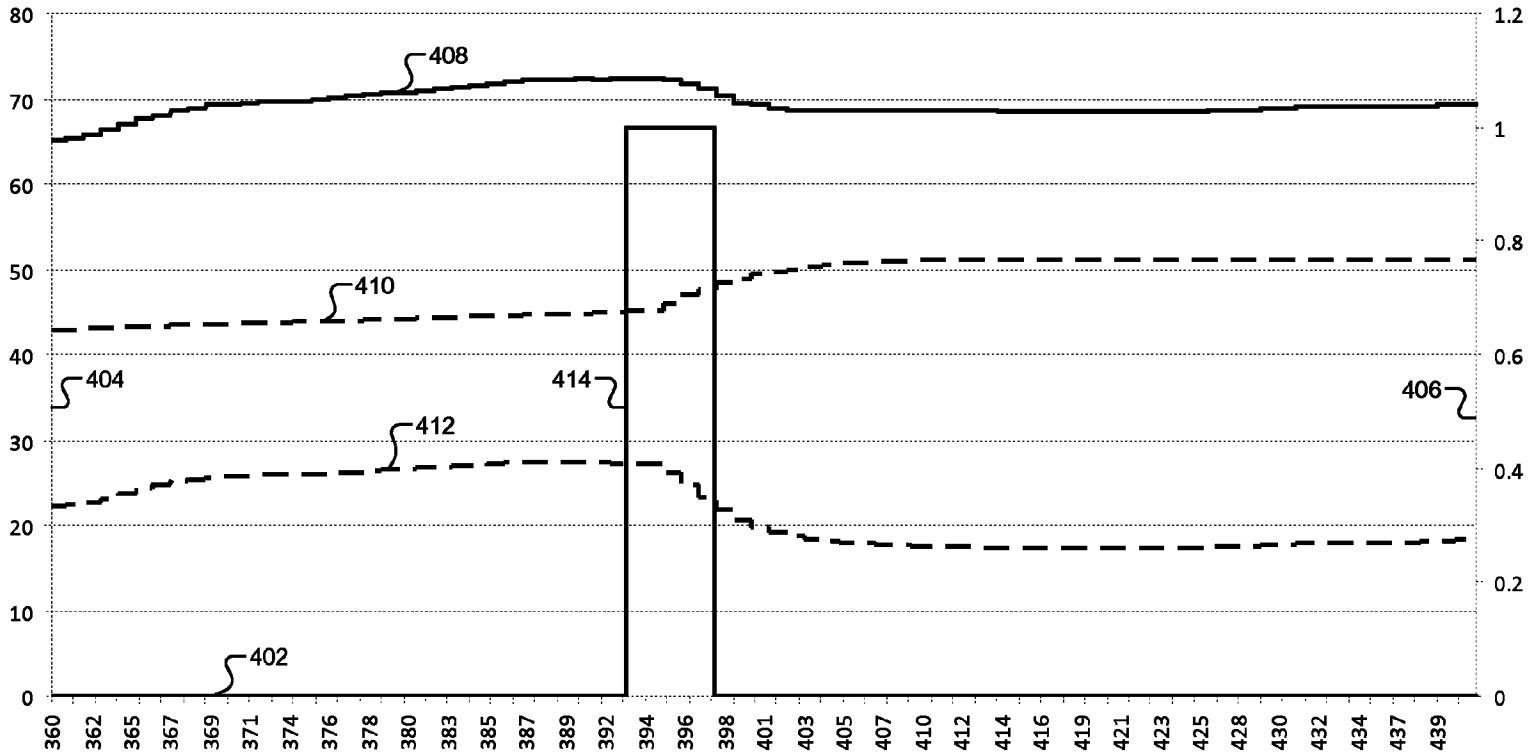
FIG. 4 is a graph illustrating example engine temperatures when a switchable water pump is switched on according to the principles of the present disclosure.

At 314, the method determines the first difference between the engine material temperature and the engine coolant temperature at the end of the diagnostic period. At 318, the method determines whether the first difference at the end of the diagnostic period is less than or equal to a second threshold. The second threshold may be a predetermined value (e.g., 6° C.) or within a predetermined range (e.g., 5° C. to 12° C.). If 318 is true, the method continues at 320 and diagnoses a stuck-on fault. Otherwise, the method continues at 322 and diagnoses a stuck-off fault. At 324, the method limits torque output of an engine. The method may limit torque output of the engine 102 by reducing fuel, retarding spark, and/or reducing throttle Referring to FIG. 4, engine temperature signals when a switchable water pump is switched on are illustrated. An x-axis 402 represents time in seconds, a left y-axis 404 represents temperature in degrees Celsius (° C.), and a right y-axis 406 represents a Boolean operator. The switchable water pump is deactivated (e.g., switched off, not flowing coolant) when the Boolean operator is 0. The switchable water pump is activated (e.g., switched on, flowing coolant) when the Boolean operator is 1.

An engine material temperature (EMT) signal 408 indicates an engine material temperature. An engine coolant temperature (ECT) signal 410 indicates an engine coolant temperature. A temperature difference signal 412 indicates the difference between the engine material temperature and the engine coolant temperature. A pump control signal 414 indicates whether the switchable water pump is activated or deactivated. The switchable water pump is activated when the pump control signal 414 aligns with 1 on the right y-axis 406. The switchable water pump is deactivated when the pump control signal 414 aligns with 0 on the right y-axis 406.

The switchable water pump is deactivated until about 393 seconds. During this period, coolant is not circulated through an engine to absorb heat from the engine. Thus, the EMT signal 408 increases at a greater rate than the ECT signal 410, and the temperature difference signal 412 increases. At about 393 seconds, the pump control signal 414 increases from 0 to 1, indicating that the switchable water pump is activated. In turn, the EMT signal 408 decreases, the ECT signal 410 increases at a greater rate relative to the rate at which the ECT signal 410 increased before the switchable water pump was activated, and the temperature difference signal 412 decreases.

At about 397 seconds, the pump control signal 414 decreases from 1 to 0, indicating that the switchable water pump is deactivated. However, the temperature difference signal 412 continues to decrease until about 405 seconds due to continued coolant flow and the response time of temperature sensors. If the switchable water pump is stuck on or off, the temperature difference signal 412 does not decrease as illustrated. Thus, a stuck-on fault or a stuck-off fault in the switchable water pump may be diagnosed based on the decrease in the temperature difference signal 412.

The stuck-on fault or the stuck-off fault may be diagnosed when a maximum decrease in the temperature difference signal 412 during a diagnostic period is less than a first threshold. The diagnostic period may start when the switchable water pump is activated, at about 393 seconds, and may end after a predetermined duration, at about 405 seconds. The first threshold may be a predetermined value (e.g., 4° C.) or within a predetermined range (e.g., 2° C. to 5° C.).

The maximum decrease may be determined based on a difference between a maximum value and a minimum value of the temperature difference signal 412 during the diagnostic period. The maximum value of the temperature difference signal 412 may be determined during a first portion of the diagnostic period that starts at about 393 seconds and ends at about 396 seconds. The minimum value of the temperature difference signal 412 may be determined during a second portion of the diagnostic period that starts at about 396 seconds and ends at about 405 seconds. Thus, the first portion may start when the diagnostic period starts, the second portion may start when the first portion ends, and the second portion may end when the diagnostic period ends.

The stuck-off fault may be diagnosed when the maximum decrease is less than the first threshold and the temperature difference signal 412 is greater than a second threshold at the end of the diagnostic period. The second threshold may be a predetermined value (e.g., 6° C.) or within a predetermined range (e.g., 5° C. to 12° C.). The stuck-on fault may be diagnosed when the maximum decrease is less than the first threshold and the temperature difference signal 412 is less than or equal to the second threshold at the end of the diagnostic period.

The foregoing description is merely illustrative in nature and is in no way intended to limit the disclosure, its application, or uses. The broad teachings of the disclosure can be implemented in a variety of forms. Therefore, while this disclosure includes particular examples, the true scope of the disclosure should not be so limited since other modifications will become apparent upon a study of the drawings, the specification, and the following claims. For purposes of clarity, the same reference numbers will be used in the drawings to identify similar elements. As used herein, the phrase at least one of A, B, and C should be construed to mean a logical (A or B or C), using a non-exclusive logical OR. It should be understood that one or more steps within a method may be executed in different order (or concurrently) without altering the principles of the present disclosure.

As used herein, the term module may refer to, be part of, or include an Application Specific Integrated Circuit (ASIC); an electronic circuit; a combinational logic circuit; a field programmable gate array (FPGA); a processor (shared, dedicated, or group) that executes code; other suitable hardware components that provide the described functionality; or a combination of some or all of the above, such as in a system-on-chip. The term module may include memory (shared, dedicated, or group) that stores code executed by the processor.

The term code, as used above, may include software, firmware, and/or microcode, and may refer to programs, routines, functions, classes, and/or objects. The term shared, as used above, means that some or all code from multiple modules may be executed using a single (shared) processor. In addition, some or all code from multiple modules may be stored by a single (shared) memory. The term group, as used above, means that some or all code from a single module may be executed using a group of processors. In addition, some or all code from a single module may be stored using a group of memories.

The apparatuses and methods described herein may be implemented by one or more computer programs executed by one or more processors. The computer programs include processor-executable instructions that are stored on a non-transitory tangible computer readable medium. The computer programs may also include stored data. Non-limiting examples of the non-transitory tangible computer readable medium are nonvolatile memory, magnetic storage, and optical storage.

What is claimed is:

1. A system comprising:

a pump control module that switches a switchable water pump from off to on; and a pump diagnostic module that diagnoses a fault in the switchable water pump based on a change in a first difference between an engine material temperature and an engine coolant temperature during a period after the switchable water pump is switched from off to on, wherein the engine coolant temperature is a temperature of coolant circulated through an engine and the engine material temperature is a temperature of at least one of an engine block and a cylinder head.

2. The system of claim 1, wherein the pump diagnostic module diagnoses the fault in the switchable water pump based on a decrease in the first difference during the period.

3. The system of claim 2, further comprising a difference decrease module that determines the decrease in the first difference based on a second difference between a first value of the first difference during a first portion of the period and a second value of the first difference during a second portion of the period.

4. The system of claim 2, wherein the pump diagnostic module diagnoses the fault in the switchable water pump when the decrease in the first difference is less than a first threshold.

5. The system of claim 4, wherein the pump diagnostic module determines the first threshold based on ambient temperature.

6. The system of claim 4, wherein the pump diagnostic module diagnoses a stuck-off fault when the first difference is greater than a second threshold at an end of the period.

7. The system of claim 6, further comprising a torque limit module that limits torque output of the engine when the stuck-off fault is diagnosed.

8. The system of claim 6, wherein the pump diagnostic module diagnoses a stuck-on fault when the first difference is less than or equal to the second threshold at the end of the period.

9. The system of claim 1, further comprising a temperature difference module that determines the first difference based on input received from an engine coolant temperature sensor and an engine material temperature sensor.

10. A system comprising:

a pump control module that switches a switchable water pump from off to on; and a pump diagnostic module that diagnoses a fault in the switchable water pump based on a first difference between an engine material temperature and an engine coolant temperature when the switchable water pump is switched from off to on, wherein:

the engine coolant temperature is a temperature of coolant circulated through an engine;

the engine material temperature is a temperature of at least one of an engine block and a cylinder head; and the pump diagnostic module refrains from diagnosing the fault in the switchable water pump when the switchable water pump is off for less than a period.

11. A method comprising:

switching a switchable water pump from off to on; and diagnosing a fault in the switchable water pump based on a change in a first difference between an engine material temperature and an engine coolant temperature during a period after the switchable water pump is switched from off to on, wherein the engine coolant temperature is a temperature of coolant circulated through an engine and the engine material temperature is a temperature of at least one of an engine block and a cylinder head.

12. The method of claim 11, further comprising diagnosing the fault in the switchable water pump based on a decrease in the first difference during the period.

13. The method of claim 12, further comprising determining the decrease in the first difference based on a second difference between a first value of the first difference during a first portion of the period and a second value of the first difference during a second portion of the period.

14. The method of claim 12, further comprising diagnosing the fault in the switchable water pump when the decrease in the first difference is less than a first threshold.

15. The method of claim 14, further comprising determining the first threshold based on ambient temperature.

16. The method of claim 14, further comprising diagnosing a stuck-off fault when the first difference is greater than a second threshold at an end of the period.

17. The method of claim 16, further comprising limiting torque output of the engine when the stuck-off fault is diagnosed.

18. The method of claim 16, further comprising diagnosing a stuck-on fault when the first difference is less than or equal to the second threshold at the end of the period.

19. The method of claim 11, further comprising determining the first difference based on input received from an engine coolant temperature sensor and an engine material temperature sensor.

20. A method comprising:

switching a switchable water pump from off to on;

diagnosing a fault in the switchable water pump based on a first difference between an engine material temperature and an engine coolant temperature when the switchable water pump is switched from off to on, wherein the engine coolant temperature is a temperature of coolant circulated through an engine and the engine material temperature is a temperature of at least one of an engine block and a cylinder head; and refraining from diagnosing the fault in the switchable water pump when the switchable water pump is off for less than a period.

* * * * *